US006912934B2

(12) United States Patent
Liao

(10) Patent No.: US 6,912,934 B2
(45) Date of Patent: Jul. 5, 2005

(54) RATCHET SCREWDRIVER

(76) Inventor: Hui-Chen Liao, No. 14, Lane 155, Sec. 3, Hsi-Tun Rd., Taichung (TW)

( * ) Notice: Subject to any disclaimer, the term of this patent is extended or adjusted under 35 U.S.C. 154(b) by 35 days.

(21) Appl. No.: 10/703,477

(22) Filed: Nov. 10, 2003

(65) Prior Publication Data

US 2005/0097994 A1 May 12, 2005

(51) Int. Cl.[7] ..... B25B 13/00
(52) U.S. Cl. ..... 81/58.3; 81/58.4; 81/177.8
(58) Field of Search ..... 81/58.3, 58, 58.4, 81/60, 121.1, 124.3, 176.15, 176.2, 177.85, 81/177.7, 177.8

(56) References Cited

U.S. PATENT DOCUMENTS 1,521,331 A * 12/1924 Sedgley ..... 81/58.3
4,270,417 A * 6/1981 Tesoro ..... 81/62
5,737,982 A * 4/1998 Lin ..... 81/58.3
5,875,692 A * 3/1999 Lin ..... 81/58.3
5,911,800 A * 6/1999 Roberts et al. ..... 81/177.85
6,253,645 B1 * 7/2001 Lin ..... 81/58.3

* cited by examiner

*Primary Examiner*—Joseph J. Hail, III
*Assistant Examiner*—Alvin J Grant
(74) *Attorney, Agent, or Firm*—Rosenberg, Klein & Lee

(57) ABSTRACT

A ratchet screwdriver has a body and a driving portion. The body has a handle, a shank integrally formed on the handle, a post with a non-circular periphery pivoted with the shank and a head formed on the post. The driving portion has a spring mounted on the post, a cylinder with a non-circular inner periphery mounted on the post, and a chuck mounted on the head and used for holding the tool head. Because the driving portion of the ratchet screwdriver is longitudinally set on the body, it can reduce whole volume of the ratchet screwdriver to enable the screwdriver to be used in a small place.

6 Claims, 4 Drawing Sheets

RATCHET SCREWDRIVER

BACKGROUND OF THE INVENTION

1. Field of the Invention

The present invention relates to a ratchet screwdriver, and more particularly to a ratchet screwdriver that has a small volume and easy to carry.

2. Description of Related Art

A conventional ratchet screwdriver is a convenient hand tool used for fixing or loosening a fastener, such as a screw, hexagonal bolts etc. The conventional ratchet screwdriver has a driving portion and a handle. The driving portion is connected to the handle and has gears transversely mounted inside, the gears are fitted to each other. Because the gears are transversely mounted inside the driving portion, the driving portion will have an enlarged head, and the fitted gears inside the driving portion only allow the ratchet screwdriver to act in one direction. To make the use of the conventional screwdriver be for convenience, another type of the ratchet screwdriver is designed which can act in two directions. However, the driving portion of two directional ratchet screwdriver still has an enlarged head, and such an enlarged head is not easily inserted into a small space.

The present invention provides a ratchet screwdriver to mitigate or obviate the aforementioned problem.

SUMMARY OF THE INVENTION

The primary objective of the present invention is to provide a ratchet screwdriver that has a body and a driving portion. The body has a handle, a shank integrally formed on the handle, a post with a non-circular periphery pivoted with the shank, and a head formed on the post. The driving portion has a spring mounted on the post, a cylinder with a non-circular inner periphery mounted on the post, and a chuck mounted on the head and used for holding the tool head. Because the driving portion of the ratchet screwdriver is longitudinally set on the body, it can reduce whole volume of the ratchet screwdriver thus enabling the screwdriver to be used in a confined place.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
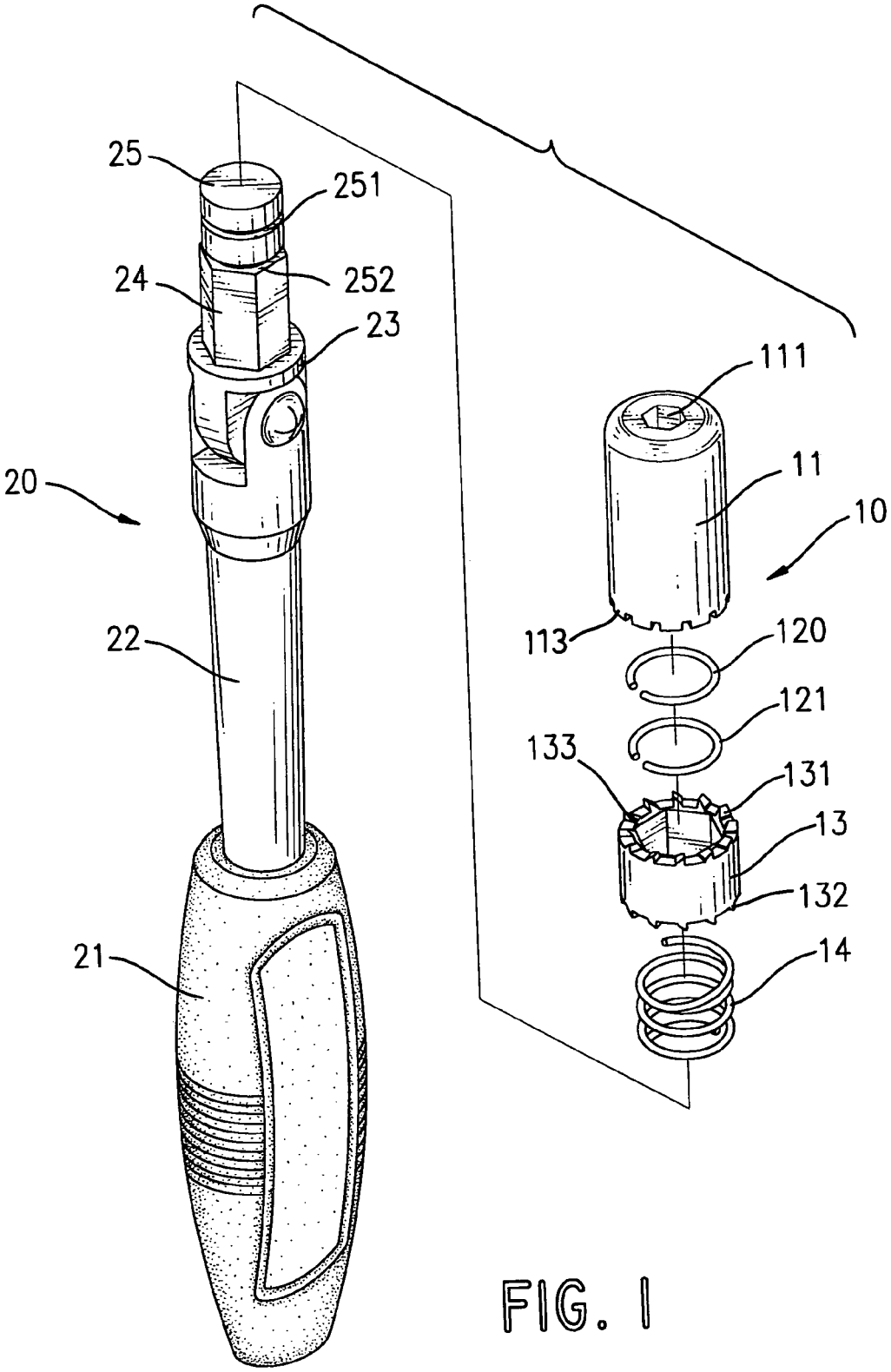
FIG. 1 is an exploded perspective view of a ratchet screwdriver in accordance with the present invention.
Figure 2:
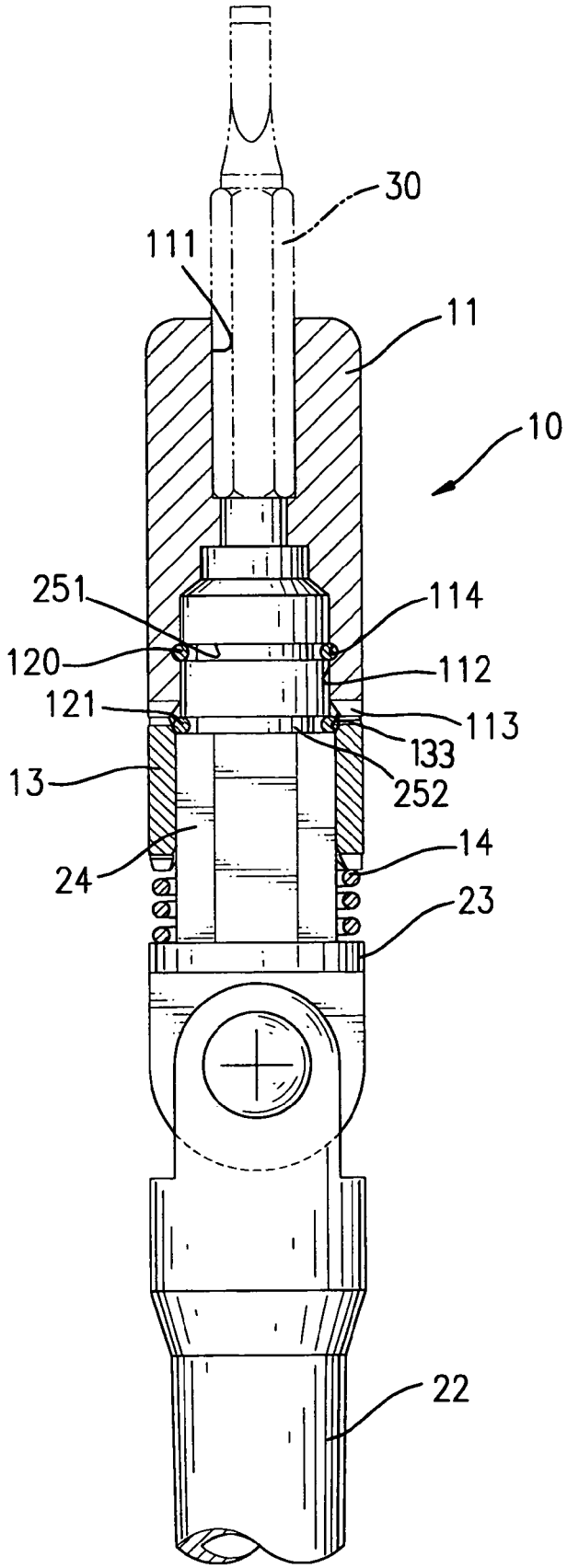
FIG. 2 is a plan view in a partial section of the ratchet screwdriver in FIG. 1.

With reference to FIGS. 1 and 2, a ratchet screwdriver in accordance with the present invention has a body (20) and a driving portion (10) mounted on the body (20).

The body (20) has a handle (21), a shank (22), an optional seat (23), a post (24), an optional first recess (251), an optional second recess (252) and a head (25). The handle (21) and the shank (22) respectively have a distal end (not numbered) and a proximal end (not numbered). The distal end of the handle (21) is connected to the proximal end of the shank (22). The post (24) has a non-circular periphery (not numbered), a distal end (not numbered) and a proximal end (not numbered). The seat (23) is formed on the distal end of the post (24). In the present invention, the non-circular periphery may be a hexagonal periphery. The proximal end of the post (24) is pivoted with the shank (22). The head (25) is a cylinder and has a periphery (not numbered). The head (25) integrally formed on the distal end of the hexagonal post (24). The optional second recess (252) is defined between the head (25) and the post (24), and the optional first recess (251) is defined in the periphery of the head (25).

The driving portion (10) has a spring (14), a cylinder (13), two optional C-shaped washers (120,121) and a chuck (11). The spring (14) has two ends (not numbered) and is mounted on the post (24). One end of the spring (14) is abutted the seat (23) or the proximal end of the post (24). Then the cylinder (13) is inserted and mounted on post (24). The cylinder (13) has a non-circular inner periphery (not numbered), a proximal end surface (not numbered), a distal end surface (not numbered) and multiple inclined inner surfaces (133). The non-circular inner periphery is shaped as the non-circular periphery of the post (24). The proximal end surface and the distal end surface respectively have multiple teeth (131,132). Each tooth (131,132) has a vertical surface (not numbered) and an inclined surface (not numbered). The inclined surface of the tooth (131) extends in a direction same as that of the inclined surface of the tooth (132). The inclined inner surfaces (133) are defined in the non-circular inner periphery near teeth (131,132). One of the optional C-shaped washers (121) is mounted inside the second recess (252) between the post (24) and the head (25). The inclined inner surfaces (133) are abutted with the C-shaped washer (121) inside the second recess (252). The other C-shaped washer (120) is mounted inside the first recess (251) on the head (25).

The chuck (11) is mounted on the head (25) and has an inner surface (not numbered), a distal end (not numbered), a proximal end (not numbered), a holding hole (111), a mounting hole (112), an optional inner recess (114) and multiple tooth-like protrusions (113). The holding hole (111) is defined through the distal end of the chuck (11), and the mounting hole (112) is defined in the proximal end of the chuck (11). The holding hole (111) communicates with the mounting hole (112) and used for holding a tool head (30). The inner recess (114) is defined in the inner surface near the mounting hole (112) and used for holding the optional C-shaped washer (120). The tooth-like protrusions (113) are formed on the proximal end surface of the chuck (11) and are selectively fitted to the teeth (131,132) on one of the end surfaces of the cylinder (13).

Figure 3:
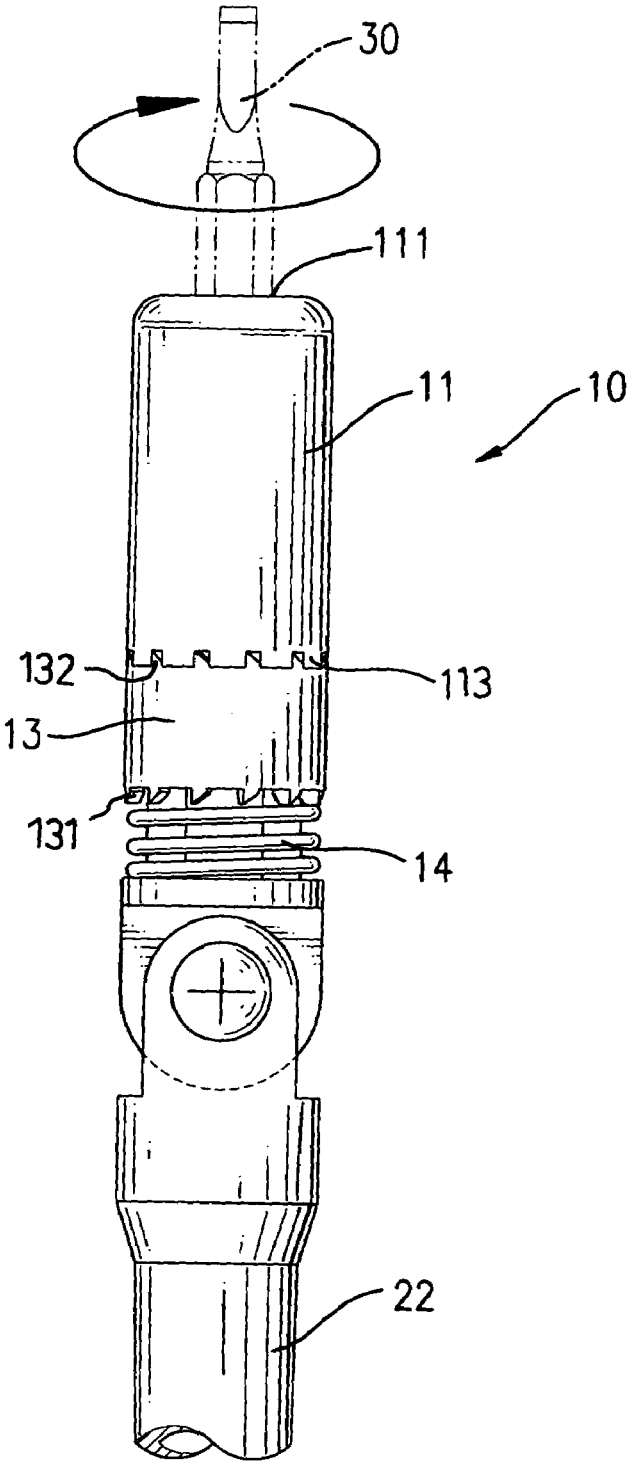
FIG. 3 is an operational perspective side view of the ratchet screwdriver in FIG. 1.
Figure 4:
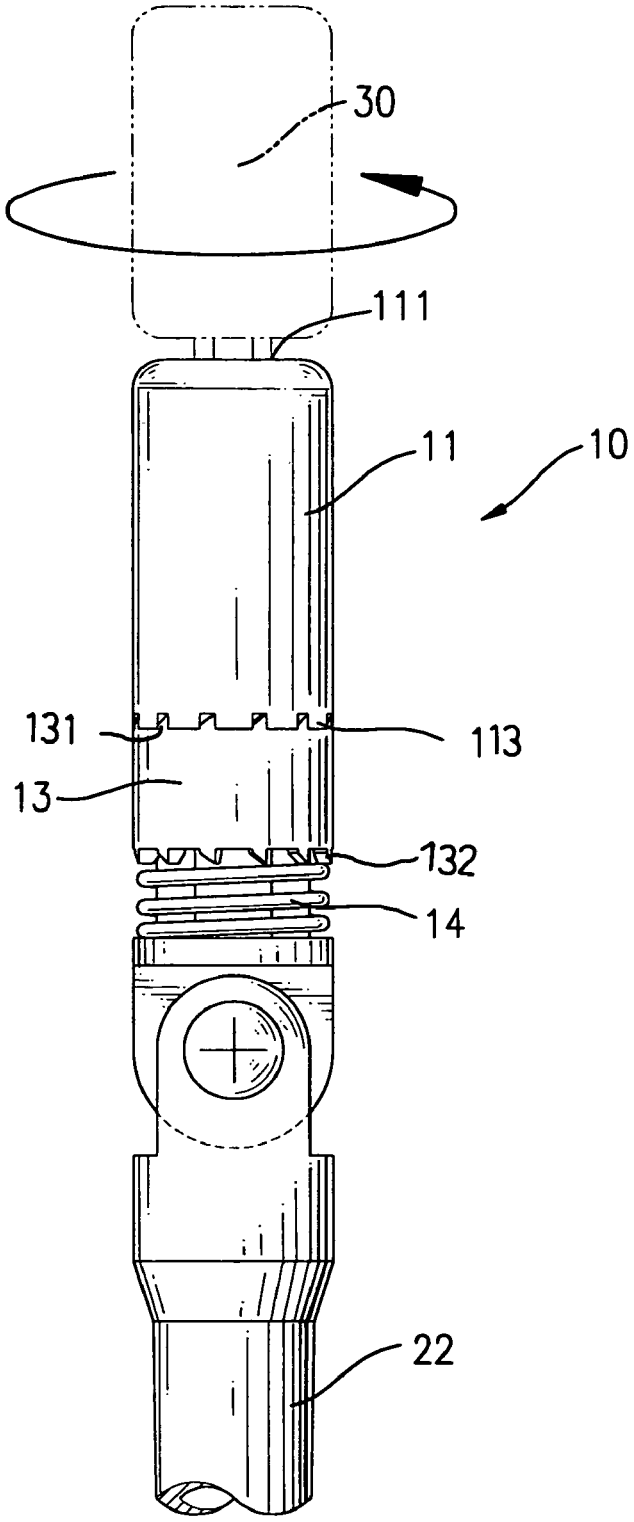
FIG. 4 is an operational perspective side view of the ratchet screwdriver in FIG. 1.

With reference to FIGS. 3 and 4, the tool head (30) is mounted inside the mounting hole (111) of the chuck (11). When the handle (21) is rotated, the non-circular periphery of the post (24) drives the cylinder (13) to rotate. The teeth (131,132) on the rotated cylinder (13) will drive the tooth-like protrusions (113) of the chuck (11). Because the teeth (131,132) have the inclined surfaces and the vertical surfaces, the tooth-like protrusions (113) will be pushed by the vertical surfaces of each of the teeth (131,132) and act in one direction. If the ratchet screwdriver in accordance with the present invention is to be driven in another direction, the cylinder (13) is taken out and refitted to change to the teeth (132,131) on the other end surface. Because the inclined inner surfaces (133) on the non-circular periphery of the cylinder (13) are abutted with the optional C-shaped washer (121), the cylinder (13) will be easily removed from the post (24). Furthermore, the spring (14) provides force to return the cylinder (13) back in place.

The ratchet screwdriver in accordance with the present invention has the following advantages:

1. Because each element of the driving portion (10) is set at a longitudinal direction, the whole ratchet screwdriver has a small driving portion. The small driving portion (10) of the ratchet screwdriver will be easily operated in a small a space.

2. The tooth-like protrusions (113) of the chuck (11) and the teeth (131,132) of the cylinder (13) are fitted with whole end surfaces, so the ratchet screwdriver in the present invention can provide a strong torsion to work without slippage.

3. The elements of the driving portion (10) of the ratchet screwdriver are simple, so that the ratchet screwdriver can be manufactured with a low cost.

Even though numerous characteristics and advantages of the present invention have been set forth in the foregoing description, together with details of the structure and function of the invention, that the disclosure is illustrative only, and changes may be made in detail, especially in matters of shape, size, and arrangement of parts within the principles of the invention to the full extent indicated by the broad general meaning of the terms in which the appended claims are expressed is to be understood.

What is claimed is:

1. A ratchet screwdriver having a body having a handle with a proximal end and a distal end, a shank with a proximal end and a distal end, the proximal end of the shank connected to the distal end of the handle, a post with a proximal end, a distal end and a non-circular periphery, the proximal end pivoted with the shank, and a head with a periphery and integrally formed on the distal end of the post, and a driving portion mounted on the body and having a cylinder mounted around the post and having a non-circular inner periphery and shaped as the non-circular periphery of the post, and a proximal end surface and a distal end surface and each end surface respectively having multiple teeth, each tooth having a vertical surface and an inclined surface, the inclined surface of each tooth on the proximal end surface extending in a direction same as that of the inclined surface of tooth on the distal end surface, and a spring with two ends and mounted on the post, one end of the spring abutted with the proximal end of the post and the other end of the spring abutted with one of the end surfaces of the cylinder, and a chuck mounted around the head and having a distal end, a proximal end, a holding hole defined through the distal end of the chuck, a mounting hole defined through the proximal end of the chuck and communicating with the holding hole, a proximal end surface, and multiple tooth-like protrusions formed on the proximal end surface and selectively engaged with the teeth on one of the end surfaces of the cylinder.

2. The ratchet screwdriver as claimed in claim 1, wherein the head further comprises a first recess defined in the periphery of the head and a second recess is defined between the non-circular post and the head, and the driving portion further comprises two C-shaped washers, one of the C-shaped washers is mounted inside the first recess to hold the chuck, the other C-shaped washer is mounted inside the second recess to hold the cylinder.

3. The ratchet screwdriver as claimed in claim 2, wherein a seat is formed at the proximal end of the non-circular post.

4. The ratchet screwdriver as claimed in claim 1, wherein the non-circular post has a hexagonal periphery.

5. The ratchet screwdriver as claimed in claim 3, wherein the non-circular post has a hexagonal periphery.

6. The ratchet screwdriver as claimed in claim 5, wherein the cylinder further comprises multiple inclined inner surfaces defined in the non-circular inner surface near the teeth.

* * * * *